US008354904B2

(12) United States Patent
Gasparini et al.

(10) Patent No.: US 8,354,904 B2
(45) Date of Patent: Jan. 15, 2013

(54) MECHANICAL OVERRIDE DEVICE

(75) Inventors: Gabriele Gasparini, Azzano San Paolo (IT); Manuel Gotti, Sedrina (IT); Stefano Magoni, Osio Sotto (IT)

(73) Assignee: ABB Technology AG, Zurich (CH)

( * ) Notice: Subject to any disclaimer, the term of this patent is extended or adjusted under 35 U.S.C. 154(b) by 0 days.

(21) Appl. No.: 13/207,477

(22) Filed: Aug. 11, 2011

(65) Prior Publication Data

US 2012/0056700 A1 Mar. 8, 2012

(30) Foreign Application Priority Data

Sep. 6, 2010 (EP) ..... 10175478

(51) Int. Cl.
*H01H 9/20* (2006.01)

(52) U.S. Cl. ..... 335/167; 335/6

(58) Field of Classification Search ..... 335/167
See application file for complete search history.

(56) References Cited

U.S. PATENT DOCUMENTS

| | | | | |
|---|---|---|---|---|
| 3,794,945 | A * | 2/1974 | Terracol | 335/188 |
| 4,048,599 | A | 9/1977 | Groth | |
| 4,301,434 | A | 11/1981 | Castonguay | |
| 4,480,833 | A * | 11/1984 | Barcelow et al. | 273/108.56 |
| 5,093,643 | A | 3/1992 | Altenhof, Jr. | |
| 6,040,746 | A * | 3/2000 | Maloney et al. | 335/13 |

FOREIGN PATENT DOCUMENTS

| | | |
|---|---|---|
| EP | 1005060 A2 | 5/2000 |
| EP | 1069585 A2 | 1/2001 |
| EP | 10175478 | 2/2011 |

* cited by examiner

*Primary Examiner* — Elvin G Enad
*Assistant Examiner* — Lisa Homza
(74) *Attorney, Agent, or Firm* — Melissa J. Szczepanik

(57) ABSTRACT

A mechanical override device which is suitable for an undervoltage coil of a switching unit, is comprised of a first portion suitable for urging a plunger of the undervoltage coil in a first position which is taken by the plunger when the undervoltage coil is energized, and a second portion suitable for receiving an external movement command for imposing an operating movement to the first portion. The override device further comprises movement control means for controlling one or more cinematic parameters of the first portion so as to make the operating movement independent from the external movement command.

11 Claims, 11 Drawing Sheets

MECHANICAL OVERRIDE DEVICE

CROSS REFERENCE TO RELATED APPLICATION

This application claims priority from European Patent Application No. 10175478.6, filed on Sep. 6, 2010, the contents of which are relied upon and incorporated by reference in their entirety, and the benefit of priority under 35 U.S.C. 119 is hereby claimed.

FIELD OF INVENTION

The present invention relates to a mechanical override device which can be used in connection with a solenoid-driven control mechanism, in particular with an undervoltage coil, of a switching unit such as a circuit breaker. The mechanical override device according to the invention can be manually operated for temporarily or permanently overriding the function of the solenoid-driven control mechanism which normally intervenes for opening the circuit breaker when an undervoltage condition occurs and enables an operator to drive the circuit breaker, in particular to close the circuit, also while the undervoltage condition is experienced. The mechanical override device is particularly suitable to be used in the Medium/Low Voltage field, i.e. for applications in the range of from 1 kV up to some tens kV, e.g. 30 kV.

BACKGROUND

A mechanical override device is known which is used for overriding the function of an undervoltage coil. The undervoltage coil, during normal operation, is kept in an excited position by an auxiliary power supply derived from the main power supply. In particular, a plunger of the coil, in the excited position, partially protrudes downwards from a coil casing.

While the undervoltage coil is in the excited position, a circuit breaker can be closed or can be kept closed. When the main power supply drops, and thus the auxiliary power supply falls below a prefixed threshold value as well, the coil, which is not longer energized, returns in a non-excited position. In the non-excited position the undervoltage coil prevents the circuit breaker from being closed. In particular, the coil plunger pushes upwards a swinging mechanism by overcoming a force which is opposed by the latter. In this way the electric circuit is opened and is also prevented from being closed.

SUMMARY

The mechanical override device comprises a supporting structure and an override lever having a first end which is pivotally connected to such a supporting structure. The override lever is rotatable in a vertical plane around a horizontal pin fixed to the supporting structure. The override lever is biased upwards by a spring which is connected to a portion of the coil casing placed above the supporting structure.

The supporting structure is fixed to an upper zone of a casing of the undervoltage coil, so that the override lever, by rotating downwards, can act on an upper end of the coil plunger. On the supporting structure there is obtained a locking seat through which the override lever extends in such a way that a grip end of the override lever protrudes outside the supporting structure. The grip end can be grasped and moved by an operator for overriding the undervoltage coil. The locking seat has an outline which enables the override lever to be hooked either down in a locking position, in which overriding of the coil is enabled, or up in a unlocking position, in which overriding of the coil is disabled so that the coil can normally operate.

In order to transfer the override lever from the unlocking position to the locking position, the operator has first to grasp and move downwards the grip end away from an upper unlocking edge of the locking seat, then he has to shift horizontally in a first direction the grip end, and subsequently the operator has to release the grip end so as to make it abut to a lower locking edge of the locking seat. Conversely, in order to transfer the override lever from the locking position to the unlocking position, the operator has to move downwards the grip end away from the lower locking edge, then he has to shift horizontally the grip end in a second direction which is opposite to the first direction, and subsequently the operator has to draw the lever upwards so as to make it abut to the upper unlocking edge.

The speed at which the override lever moves from the locking position to the unlocking position depends on the manual ability and quickness of the operator. This disadvantageously implies a releasing operation of the mechanical override device which is not always adequate and/or compliant with desired operating requirements that any standard regulation may prescribe. The modality of implementing the releasing operation changes from time to time. In other words, due to the dependence from the operator's actions, the releasing operation takes place with a speed that is never exactly the same. Generally speaking, the releasing operation speed is not repeatedly constant because of its high dependence from the subjective manual ability of the operator.

Furthermore, a risk may occur that the coil plunger is not released in its non-energized configuration while an undervoltage condition is experienced. This is due to the fact that if the override lever is moved too slowly in the unlocking position, a return force of the plunger coil is not able to counter and overcome a reaction force which is exerted by the swinging mechanism. This implies a dangerous situation which is inacceptable.

Furthermore, the known mechanical override is very difficult to be fit in an undervoltage coil after market and requires noticeably structural modifications and even a replacement and change of size of the undervoltage coil.

It is desirable to improve the known mechanical override device, and to provide a mechanical override device which is able to overcome all the above mentioned drawbacks.

Such an improved mechanical override device is provided according to the present invention as defined in the appended claims.

BRIEF DESCRIPTION OF THE DRAWINGS

Further characteristics and advantages of the invention will emerge from the description of preferred, but not exclusive embodiments of the mechanical override device according to the invention, non-limiting examples of which are provided in the attached drawings, wherein.

DETAILED DESCRIPTION

Figure 2:
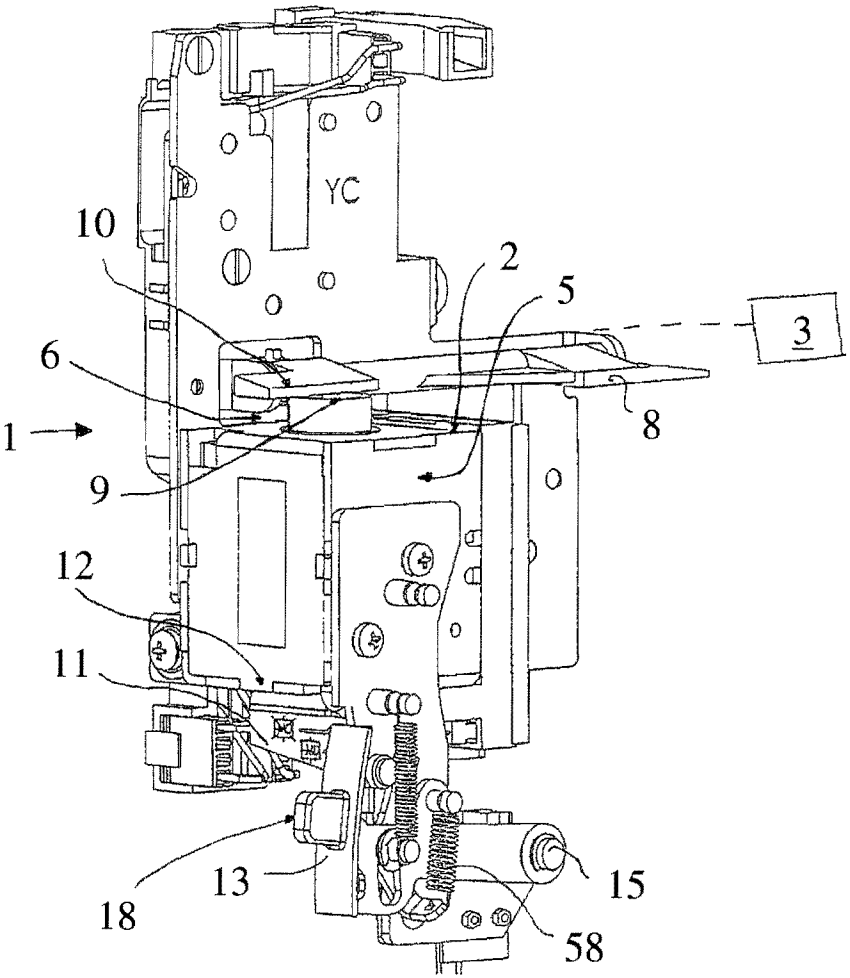
FIGS. 2 and 3 are further perspective views of the mechanical override device of FIG. 1 which is connected to an undervoltage coil.
Figure 1:
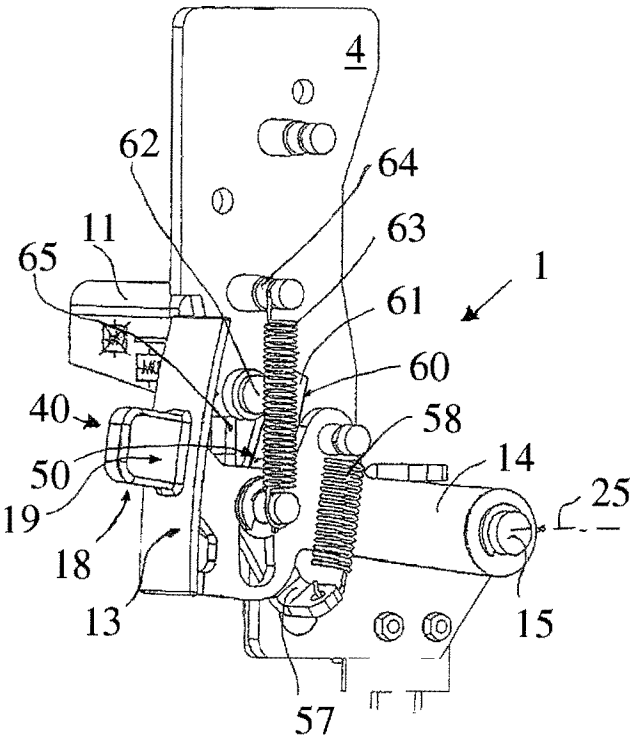
FIG. 1 is a perspective view of a first embodiment of the mechanical override device according to the invention.
Figure 3:
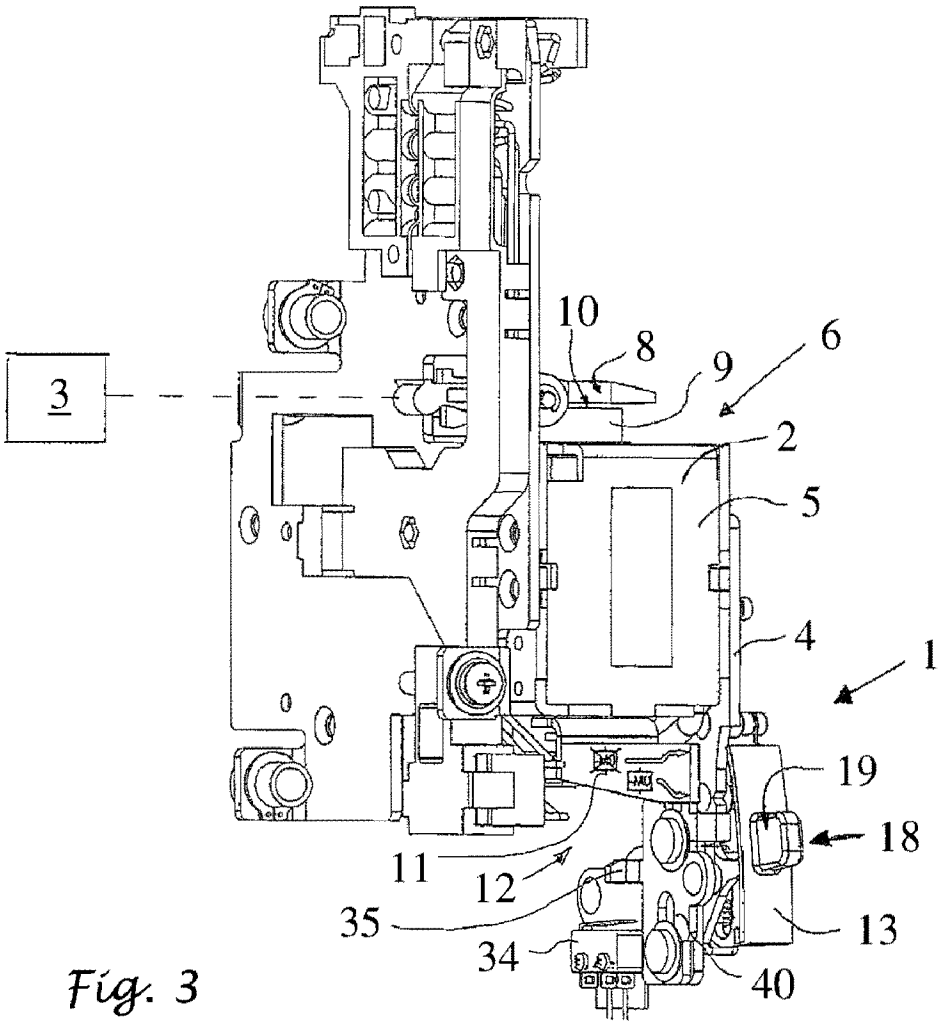
Figure 5:
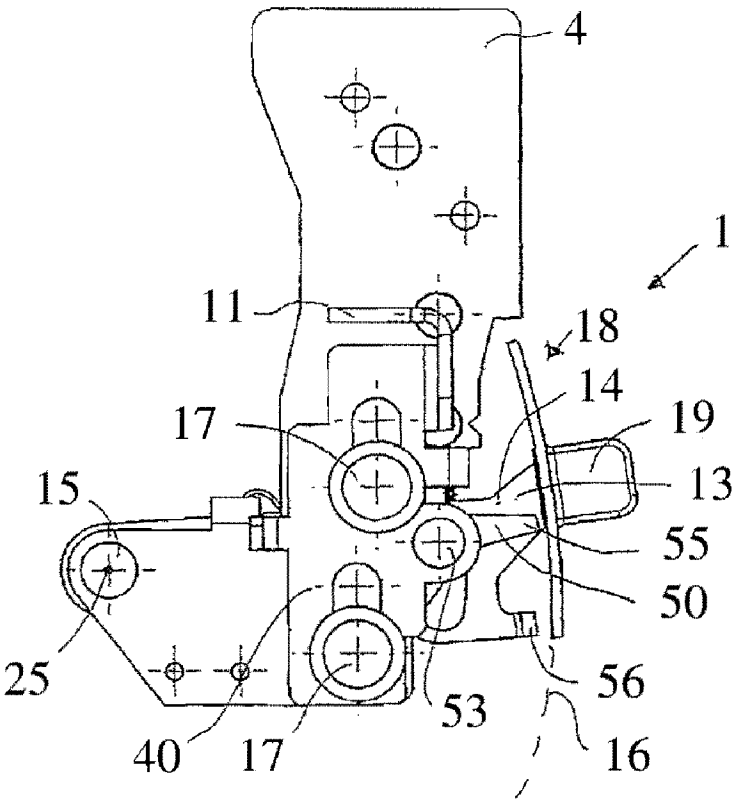
FIGS. 4 and 5 are a frontal view and a side view respectively of the mechanical override device according to the invention.
Figure 4:
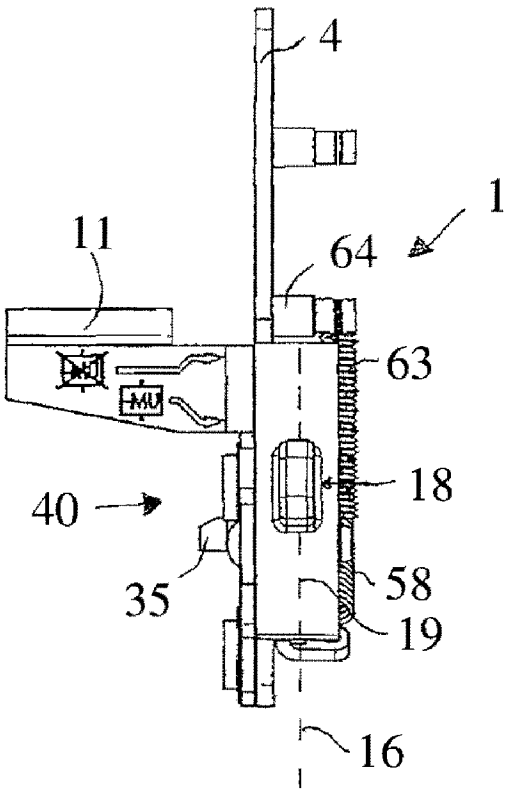
Figure 11:
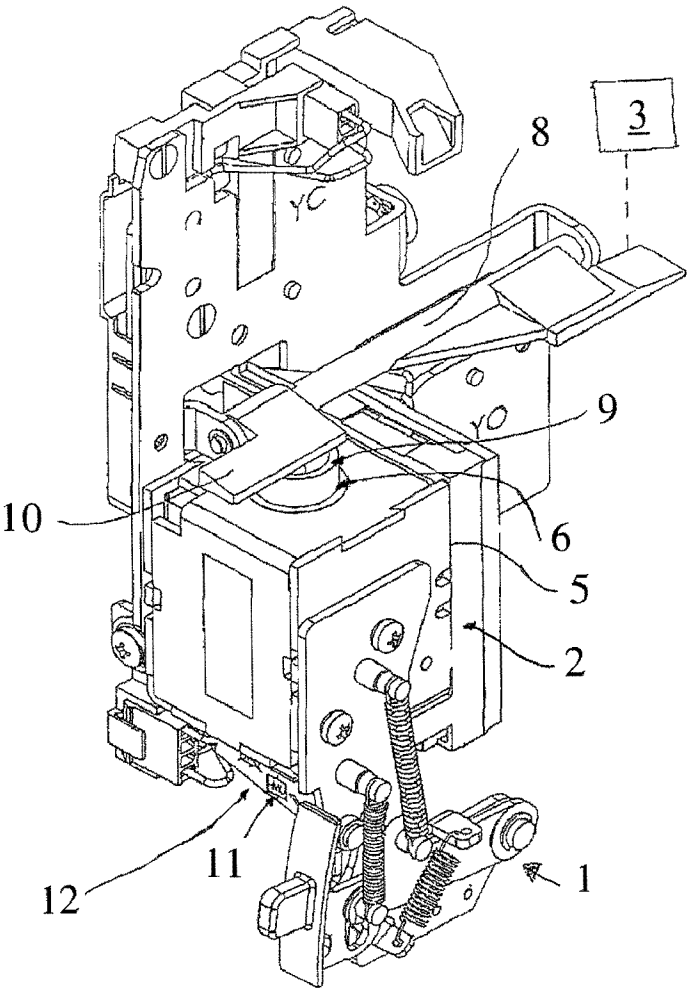
FIG. 11 is a further perspective view of the mechanical override device of FIG. 10 which is connected to an undervoltage coil.
Figure 10:
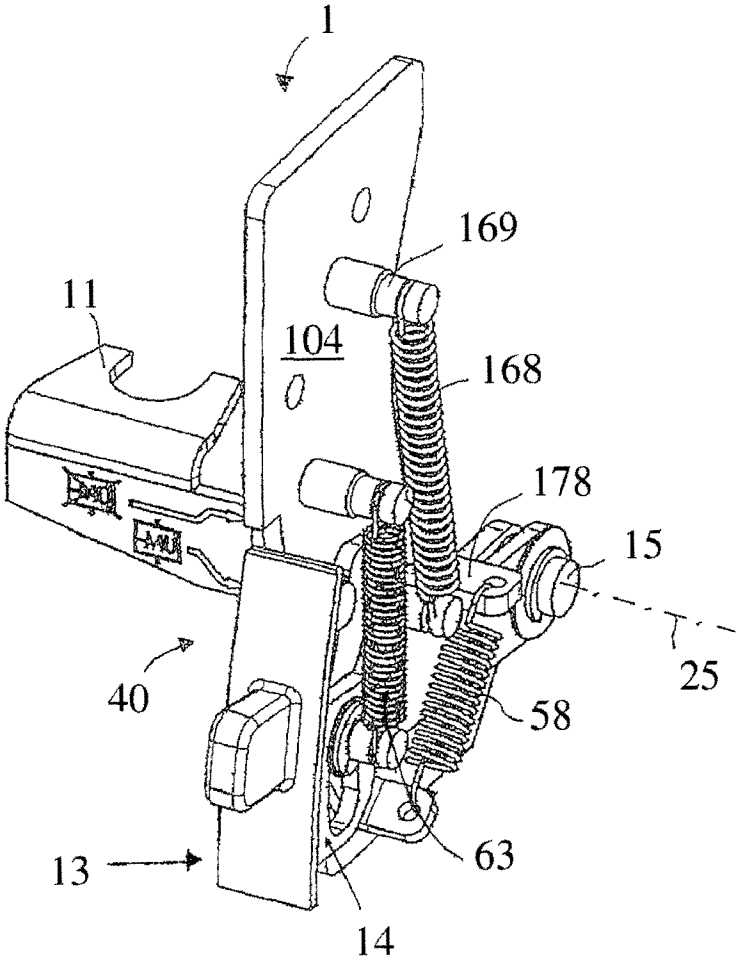
FIG. 10 is a perspective view of a second embodiment of the mechanical override device according to the invention.
Figure 13:
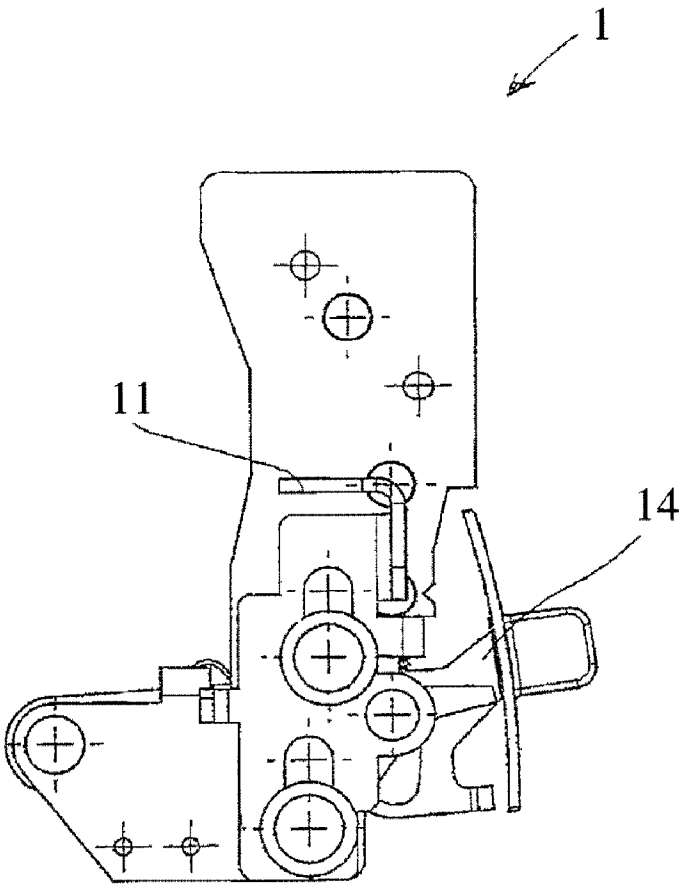
FIGS. 12 and 13 are a frontal view and a side view respectively of the mechanical override device of FIG. 10.
Figure 12:
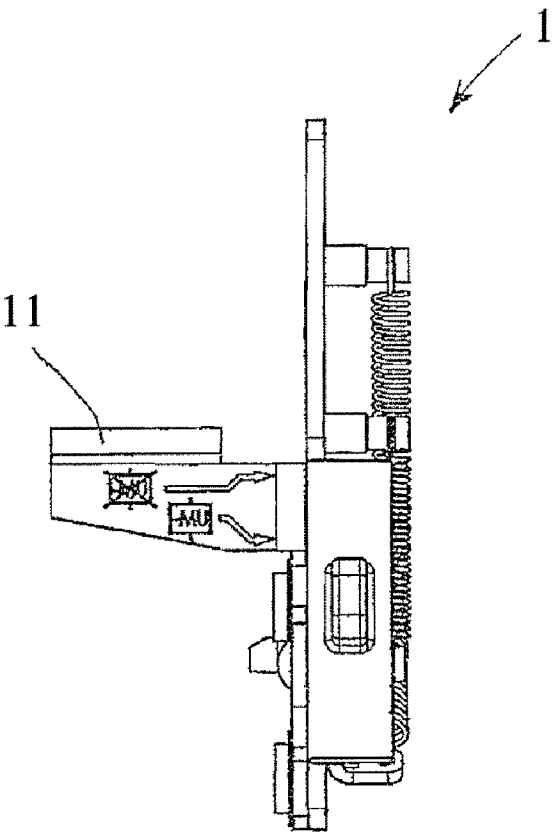

With reference to the attached Figures, a mechanical override device 1 is illustrated which can be used in connection with a solenoid-driven control mechanism 2, in particular with an undervoltage coil 2, of a switching unit 3, for example, a circuit breaker 3, schematically shown in FIGS. 2, 3 and 11.

The mechanical override device 1 is particularly suitable to be used in the Medium/Low Voltage field, i.e. for applications in the range from about 1 kV to about 30 kV.

The mechanical override device of the invention can be manually operated for temporarily or permanently overriding the function of the undervoltage coil 2 which normally acts for opening a circuit breaker 3 when an undervoltage condition occurs in an auxiliary supply of the undervoltage coil 2 itself; the auxiliary supply is typically derived from a main supply. The mechanical override device 1 enables an operator to drive the circuit breaker 3, in particular to close the circuit breaker 3, also while the undervoltage condition is experienced. The mechanical override device 1 is very useful, for example, in the installation and setting up of a system in which the circuit breaker 3 is included. In this case, if the auxiliary supply of the undervoltage coil 2 is not yet available, and this would make impossible to drive the circuit breaker 3. Owing to the mechanical override device 1, the operator can execute check-driving-operations to verify a correct running of the system. Therefore, the mechanical override device ensures an electric operating continuity in spite of the lack of auxiliary supply of the undervoltage coil 2.

During normal operation, the undervoltage coil 2 is energized by the auxiliary supply. While the undervoltage coil 2 is energized, a plunger 6, included therein, is kept in an excited position. In the excited position the plunger 6 is for example in an extended position 7. In particular, in the extended position 7, the plunger 6 partially protrudes downwards from a casing 5 of the undervoltage coil 2.

While the undervoltage coil 2 is in the excited position, an operator can freely operate on the circuit breaker 3, in particular the latter can be closed. As long as the undervoltage coil 2 is energized, the circuit breaker 3 can be kept closed. When the voltage of the main supply drops, the auxiliary supply falls below a prefixed threshold value, i.e. an undervoltage condition occurs. Consequently, the undervoltage coil 2 is not longer energized and returns in a non-excited position. In particular a recovery-coil-spring, arranged inside the undervoltage coil 2, pulls the plunger 6 in a drawn back position. In the non-excited position the circuit breaker 3 is opened and the undervoltage coil 2 prevents the circuit breaker 3 from being closed through a swinging mechanism comprising a swinging rod 8. The swinging rod 8 cooperates with an upper end 9 of the plunger 6 and is operatively connected to the circuit breaker 3. In particular, the plunger 6 pushes upwards a flap portion 10 of the swinging rod 8 by overcoming a force which is opposed by the latter, thus opening the circuit breaker 3 and preventing the latter from being closed.

The mechanical override device 1, which will be now described in detail, makes possible to close the circuit breaker 3 even when the undervoltage coil 2 is not energized, i.e. in an undervoltage condition, by pulling the plunger 6 to its extended position, i.e. in the position which is normally taken by the plunger 6 when the undervoltage coil 2 is energized in normal operating conditions.

Figure 6:
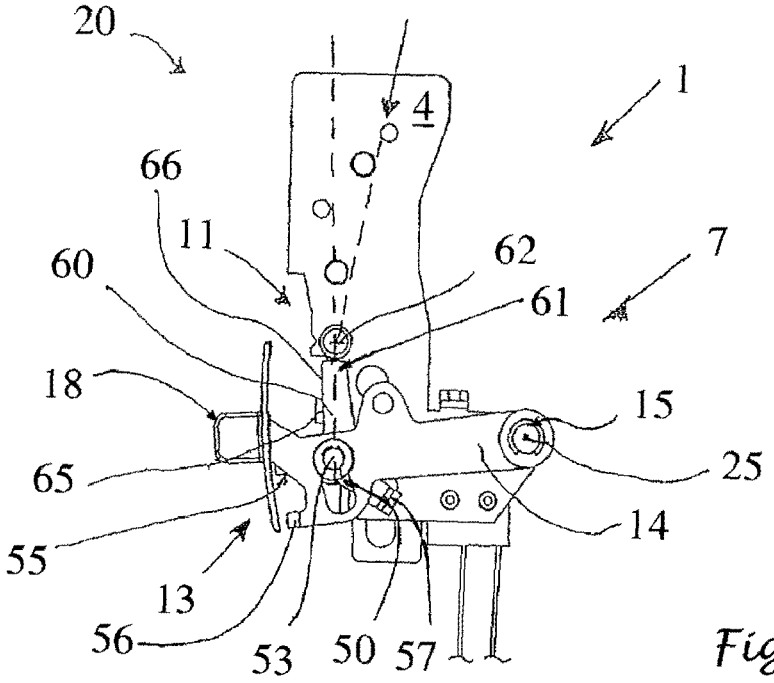
FIG. 6 is a further side view of the mechanical override device of FIG. 1 where some details have been removed.
Figure 7:
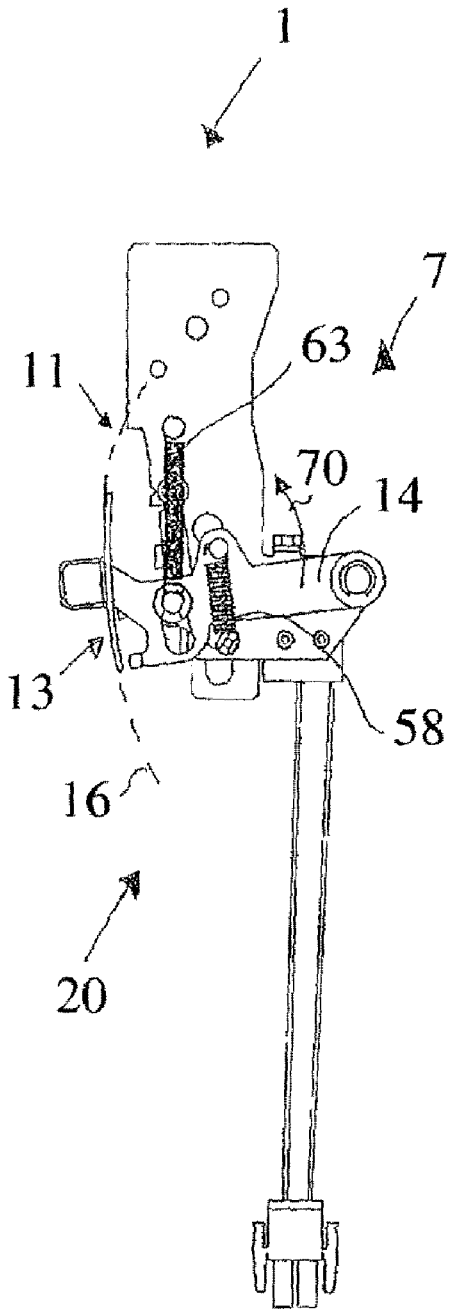
FIGS. 7 and 8 show the first embodiment of the mechanical override device in a locking configuration and in an unlocking configuration, respectively.
Figure 8:
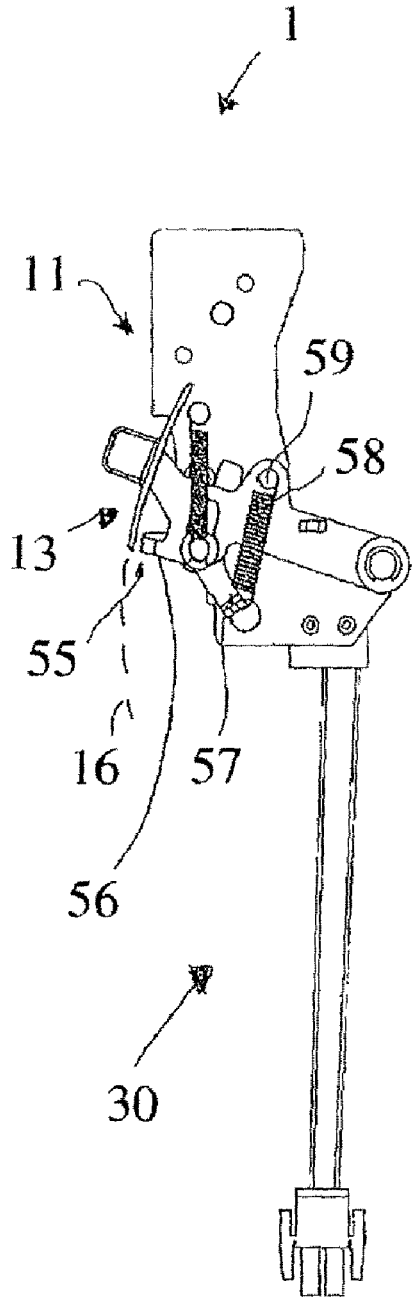

With reference to FIGS. 1 through 9, a first embodiment of a mechanical override device 1 according to the invention is described. In particular, the mechanical override device 1 according to this first embodiment is configured for permanently overriding, upon an external movement command, in particular a locking external command by an operator, the function of the undervoltage coil 2 and for keeping the undervoltage coil 2 in a corresponding overriding configuration for an undefined period once the locking external command is over and till a further external movement command, in particular an unlocking external command, is given by the operator. In other words, once the permanent mechanical override device 1 has been put in a locking configuration 20 shown in FIG. 7, the permanent mechanical override device 1 is able to remain endlessly and autonomously in such a configuration without the need for any further external actions by the operator. In order to bring the permanent mechanical override device 1 to an unlocking configuration 30, as shown in FIG. 8, the operator has to impart on the permanent mechanical override device 1 an unlocking movement.

In this embodiment, the override device 1 comprises a supporting plate 4 which is shaped for being fixed for example to the casing 5 of the undervoltage coil 4 and a first portion 11 which is suitable for urging the plunger 6 in the above mentioned extended position. In particular, the first portion comprises a U-shaped portion 11 suitable for coupling with a lower end 12 of the plunger 6, opposite to the upper end 9. More particularly, the U-shaped portion 11 is configured for abutting on a flange element protruding radially from the lower end 12. In an undervoltage condition, when the device 1 is driven to be put in the locking configuration 20, as shown in FIG. 7, the U-shaped portion 11 is moved in a lower position thus pushing the flange element downwards and pulling the plunger 6 into the extended position.

In normal operating conditions, when the device 1 is arranged in the unlocking configuration 30 (FIG. 8), the U-shaped portion 11 is in an upper position and does not interfere with the plunger 6, i.e. the U-shaped portion 11 does not oppose an autonomous movement of the plunger 6 downwards.

Owing to the first portion 11 being so configured for coupling with the lower end 12 of the plunger 6, a risk of undesired mechanical interference with the swinging mechanism 8 is avoided, and a high versatility and assembling adaptability of the mechanical override device to undervoltage coils 2 of different size is achieved. This enables to easily fit the mechanical override device of the invention to undervoltage coils after market, i.e. to undervoltage coils already sold and in use.

The U-shaped portion 11 is obtained as a transverse protrusion from a slide element 40. The slide element 40 is slideably connected to the supporting plate 4 through a slot-pin connection 17, better shown in FIGS. 5 and 9. The slot-pin connection 17 enables the slide element 40 to rectilinearly slide from the lower position of FIG. 7, to the upper position of FIG. 8.

In this exemplary embodiment, the device 1 comprises also a second portion 13 suitable for receiving an external movement command for imposing an operating movement to the first portion 11. In particular, the second portion 13 can be grasped by an operator for driving the first portion 11, in particular for moving up and down the u-shaped portion 11. The second portion 13 comprises a command lever 14 which is pivotally connected to the supporting plate 4. The command lever 14 is able to rotate around a first pin 15 from an upper position, which is shown in FIG. 8 and corresponds to the unlocking configuration 30, to a lower position, which is shown in FIG. 7 and corresponds to the locking configuration 20.

The command lever 14 comprises a grasping end 18 which is intended to be grasped by an operator for moving the command lever 14. The grasping end 18 can be externally provided with an ergonomic covering element 19.

The command lever 14 can only move in a prefixed plane which is substantially orthogonal to a longitudinal axis 25 of the first pin 15. The command lever 14 moves along a plane path, in particular along an arc shaped path 16, and is connected to the supporting plate 4 so as to prevent any shifting-component parallel to the above mentioned longitudinal axis 25. In this way, the command lever 14 can move along the prefixed arc shaped path without undesired oscillations transversely to the path and can thus be easily handled.

Figure 9:
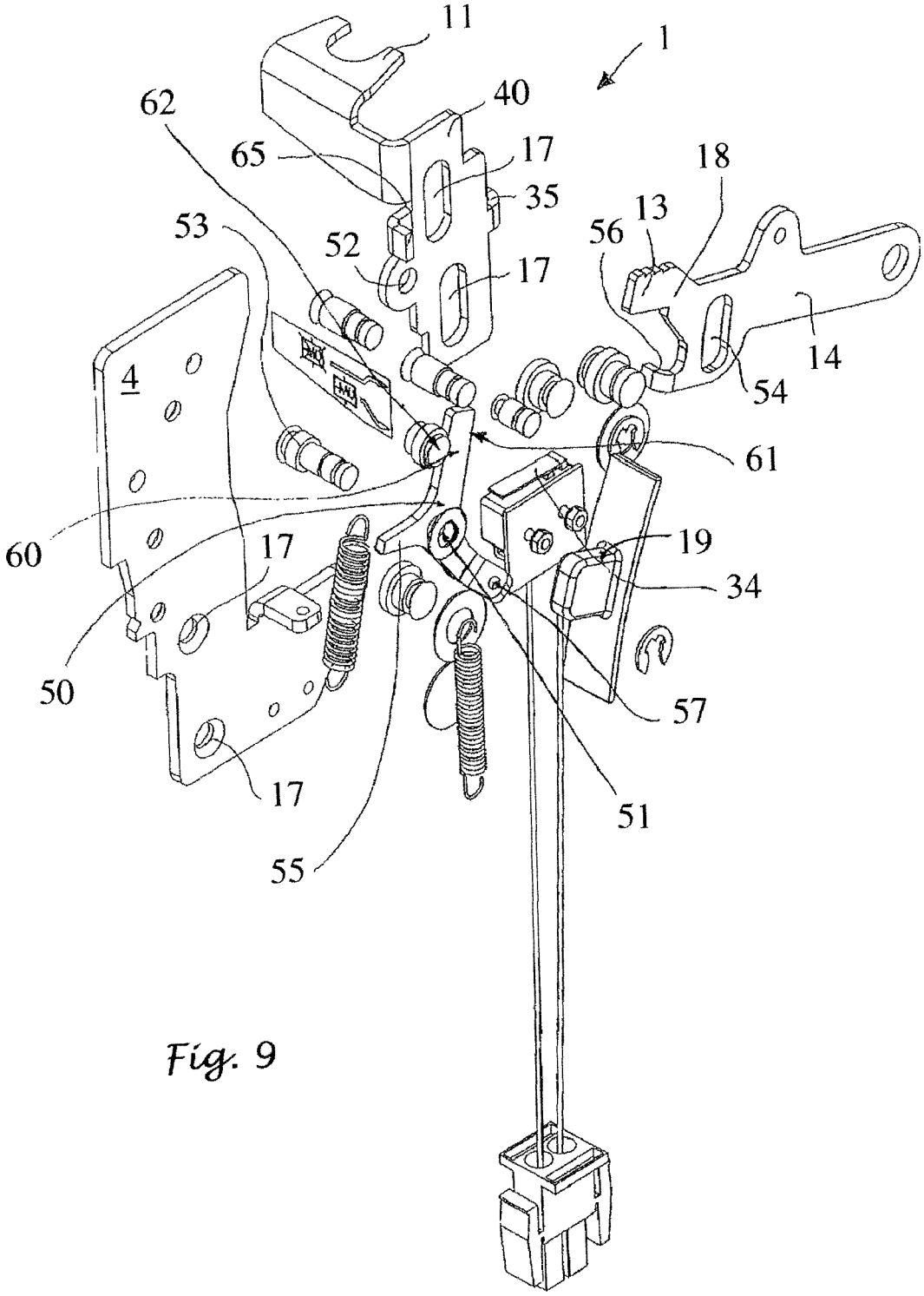
FIG. 9 is an exploded view of the mechanical override device according to the invention.

The permanent mechanical override device 1 comprises a permanent holding element 50, better shown in FIG. 9, which is configured for cooperating with elastic means (which will be described further on) for permanently holding the slide element 40, and thus the U-shaped portion 11, in the locking position of FIG. 6 or 7, once an external movement command directed to put the device 1 in the locking configuration 20 is over and the command lever 14 is thus released by the operator.

The permanent holding element 50 is pivotally connected to the slide element 40 and slideably and pivotally connected to the command lever 14. The permanent holding element 50 is interposed between the slide element 40 and the command lever 14.

In particular, in a substantially central zone of the permanent holding element 50, there is obtained a coupling hole 51. A suitable connection pin 53, which is received in the coupling hole 51 and also in a further coupling hole 52 of the slide element 40, pivotally connects the permanent holding element 50 to the slide element 40. The connection pin 53 is also received in a slot 54 obtained in the command lever 14 so that the permanent holding element 50, and thus also the slide element 40, is slideably and pivotally connected to the command lever 14.

The connection pin 53 is connected, through a return spring 63 included in the elastic means, to a further connection pin 64 which is fixed to, and transversally protrudes from, the supporting plate 4. The return spring 63 acts for pulling upwards, in the unlocking configuration, the connection pin 53, and thus the assembly defined by the permanent holding element 50, the command lever 14 and the slide element 40. The return spring 63 is properly sized in order to pull the above mentioned assembly with a suitable traction force. In this way, a proper traction force of the return spring 63, taking into account also a pulling action exerted by the recovery-coil-spring included in the undervoltage coil 2, ensures a correct movement of the first portion 11 towards the unlocking configuration 30.

The permanent holding element 50 is shaped as a three-arm element, or as a three-pointed star element. In particular, the permanent holding element 50 comprises an unhooking arm 55, also visible in FIG. 5, which is shaped for cooperating with an unhooking protrusion 56 which transversely projects from the command lever 14. The function of the unhooking arm 55 and of the unhooking protrusion 56 will be described further on.

The permanent holding element 50 comprises a holding arm 60 having a permanent holding end 61 which is shaped for cooperating with a holding protrusion 62 fixed to the supporting plate 4. The holding arm 60 will be described in detail further on.

The permanent holding element 50 comprises a biasing arm 57 which is shaped for being connected, through a biasing spring 58 included in the elastic means, to a pin 59 (better shown in FIG. 8) which is fixed to the command lever 14. The biasing spring 58 acts so as to rotate the permanent holding element 50 in a first rotation direction 70 so that a contacting surface 66 of the permanent holding arm 60 abuts against a stationary stop protrusion 65 (better shown in FIGS. 6A and 9) which transversely protrudes from the supporting plate 4.

The unhooking arm 55, the biasing arm 57 and the holding arm 60 extend substantially radially with respect to the coupling hole 51, so as to define a plane which is parallel to a rotation plane of the command lever 14, and are suitably angularly spaced with respect to one other. The holding arm 60 and the biasing arm 57 diverge from each other so as to define there between a first region 80. The holding arm 60 and the unhooking arm 57 diverge from one other so as to define there between a second region 90, which is nearer to the grasping end 18, with respect to the first region 80.

The holding arm 60 has a function to hold the first portion 11, i.e. the U-shaped portion 11, and thus the slide element 40, in the locking configuration which is shown in FIGS. 6 and 7. This is achieved by the permanent holding end 61 abutting on a lower surface of the holding protrusion 62. The permanent holding end 61 has a profile which is properly shaped for cooperating with the lower surface of the holding protrusion 62 so as to firmly hold the permanent holding element 50 in a stationary position, thus preventing any free rotation thereof. In other words, with reference to FIG. 6A, the profile of the permanent holding end 61 is slightly sloping towards the first region 80, i.e. the profile of the permanent holding end 61 is descending from the second region 90 towards the first region 80. In practice, the holding end 61 is delimited by a surface which is shaped in such a way that an incident line drawn orthogonally on the holding end 61 intersects the second region 90 and results convergent towards the unhooking arm 55.

Figure 6A:
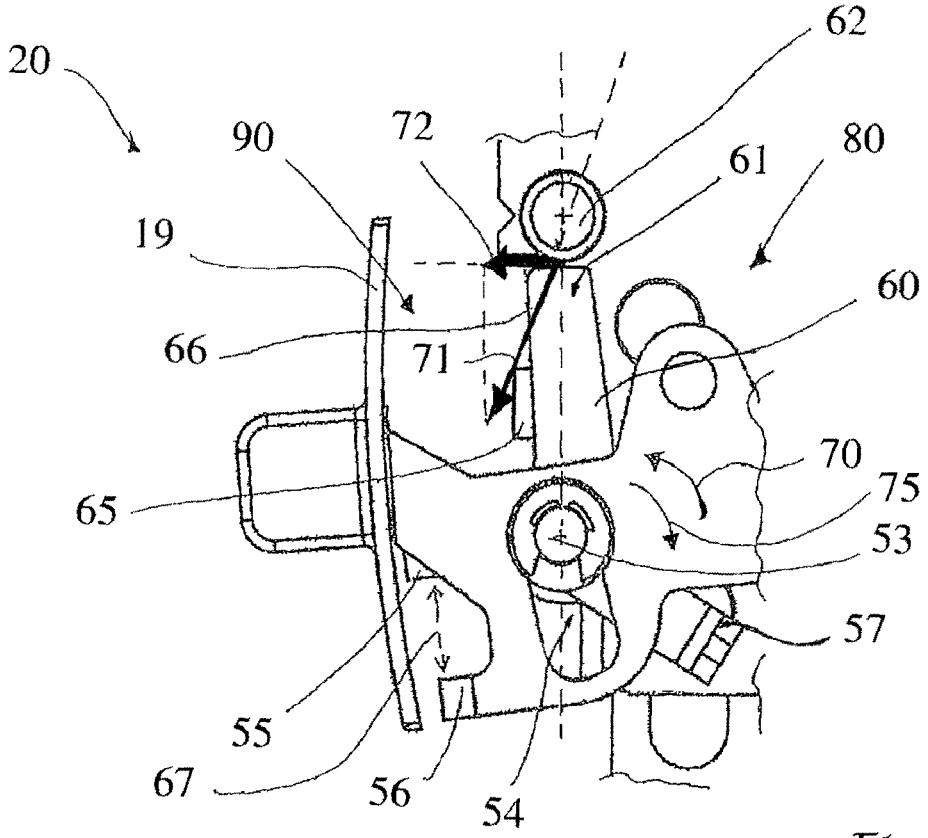
FIG. 6*a* is an enlarged view of a detail of FIG. 6.

The permanent holding arm 60, and in particular the permanent holding end 61 is configured so that, in the locking configuration 20 (as shown in FIGS. 6, 6A and 7), a reaction force 71 that the holding protrusion 62 exerts on the permanent holding end 61 is directed to the second region 90 and has a tangential component 72 pointing substantially towards the covering element 19. This means that the reaction force 71 is such that to keep the permanent holding element 50 pushed against, and rested on, the stop protrusion 65.

Thanks to the above described structural configuration, in particular of the permanent holding end 61, the permanent mechanical override device 1 is able, once put in the locking configuration 20, to remains on its owns in such a configuration without the need for any intervention or action of an operator.

Functioning of the override device 1 according to the exemplary embodiment of FIGS. 1-9, is described in the following. In normal operating conditions, the undervoltage coil 2 is energized and the device 1 is in the unlocking configuration 30, in which the command lever 14 is kept in an upper position by the return spring 63. Also the permanent holding element 50 and the slide element 40 are arranged in an upper position. The permanent holding element 50 is angularly positioned so that the holding arm 60 is kept away from the stop protrusion 65, i.e. the contacting surface 66 is separated and spaced apart from the stop protrusion 65. In particular, the permanent holding end 61 is separated from the holding protrusion 62 whereas the contacting surface 66 abuts against the latter due to the action of the biasing spring 58.

When it is desired to override the function of the undervoltage coil 2 to prevent the circuit breaker 3 to be opened because of a possible undervoltage condition, the operator has to grasp the command lever 14 and move the latter downwards, by overcoming the action of the return spring 63. As the command lever 14 is lowered, the permanent holding element 50 is lowered too. The contacting surface 66 moves downwards by sliding on the holding protrusion 62 until the holding arm 60 arranges itself under the holding protrusion 62 and rotates towards the stop protrusion 65. Therefore, the permanent holding end 61 contacts from below the holding protrusion 62 and owing to its profile remains stably in this configuration once the operator releases the command lever 14. The command lever 14 is kept biased downwards by the biasing spring 58, so that an upper edge of the slot 54 rests on the connection pin 53. In this locking configuration 20 the unlocking protrusion 56 is separated and spaced apart from the unlocking arm 55.

A suitable contact sensor 34 (better shown in FIGS. 3 and 9), cooperating with a contact protrusion 35 of the slide element 40, provides to a remote unit or station a signal indicating the status of the mechanical override device 1, i.e. indicating whether the mechanical override device 1 is in the locking configuration 20 or in the unlocking configuration 30.

When the operator desires to restore the device 1 in the unlocking configuration 30, he can move the command lever 14 upwards. In particular, for a first path portion, until the unhooking protrusion 56 does not contact the unhooking arm 55, the command lever 14 does not affect the current position of the permanent holding element 50. The relative movement between the command lever 14 and the permanent holding element 50 is made possible by the slot 54 connection.

In other words, until the command lever 14 rotates within a certain angular range corresponding to such a first path portion in which the unhooking protrusion 56 does not push the unhooking arm 55, the mechanical override device 1 is stable in the locking configuration 20. In other words, within the abovementioned first path portion an idling movement 67 is defined for the command lever 14, which does not change the operative status of the device 1.

As the command lever 14 is raised upwards, the command lever 14 moves relative to the connection pin 53 which remains in a stationary position, this being possible owing to the slot 54 connection.

When the command lever 14 is further raised beyond the first path portion, the unhooking protrusion 56 goes in contact with and pushes the unhooking arm 55 so as to start rotating the permanent holding element 50 in a second rotation direction 75, by overcoming the action of the biasing spring 58. As the holding arm 60 rotates in the second rotation direction 75, the permanent holding end 61 progressively disengages from the holding protrusion 62 until the permanent holding end 61 suddenly slips from the holding protrusion 62. At this point, the holding protrusion 62 is no longer able to hinder an upwards movement of the holding element 50 which rapidly moves upwards thus dragging the slide element 40 to the unlocking configuration 30, upon the effect of the return spring 63, and also of the recovery coil-spring in case the coil 2 is not energized.

Once the permanent holding end 61 escapes from the holding protrusion 62, a movement upwards of the permanent holding element 50 and of the slide element 40 and thus of the first portion 11 takes place with a modality that is independent from how the command lever 14 is handled by the operator. In particular, cinematic parameters of the unlocking operating movement of the first portion 11, such as speed and acceleration, have preset values depending on the structural configuration of the permanent mechanical override device 1, in particular depending on the geometry, mass, and return action of the elastic means, and does not depend on the rapidity of the operator driving the command lever 14. This means that the unlocking operating movement of the first portion 11 is independent from the way in which the external movement command is given by the operator.

Therefore, the permanent holding element 50 and the elastic means together define movement control means for controlling one or more cinematic parameters of the first portion 11 so as to make an operating movement of the latter independent from an external movement command of the operator. Hence, the device 1 acts and can be defined also as an operator independent override device which ensures an unlocking driving operation for the undervoltage coil 2 which is adequate, reliable and constant during life time.

A second exemplary embodiment of a mechanical override device 1 according to the invention will be now described with reference to FIGS. 10-17; most components or parts of the override device of the second embodiment are structurally the same as in the first embodiment, and therefore only the differences will be hereinafter evidenced while parts that are the same in both embodiments are indicated with the same reference signs.

The mechanical override device 1 according to this second embodiment is particularly configured for temporarily overriding, upon an external movement command, in particular a locking external command by an operator, the function of the undervoltage coil 2 and for keeping the undervoltage coil 2 in a corresponding overriding configuration as long as the operator keeps the command lever 14 in the locking configuration 20. Once the operator releases the command lever 14, the temporary mechanical override device 1 automatically and autonomously returns in the unlocking configuration 30.

In practice, the mechanical override device 1 illustrated in FIGS. 10-17 is configured so that the mechanical override device 1 is not able to remain autonomously, i.e. without an external action from the operator, in the locking configuration. This prevents any inopportune long lasting overriding operations or tampering operations by an operator on the undervoltage coils 2, which could turn out to be detrimental or even dangerous in particular situations.

Figure 14:
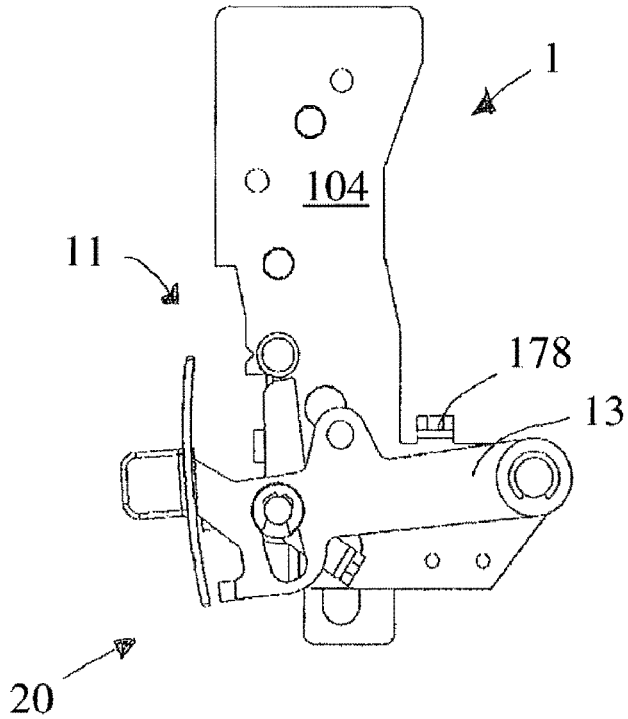
FIG. 14 is a further side view of the mechanical override device of FIG. 10 where some details have been removed.
Figure 14A:
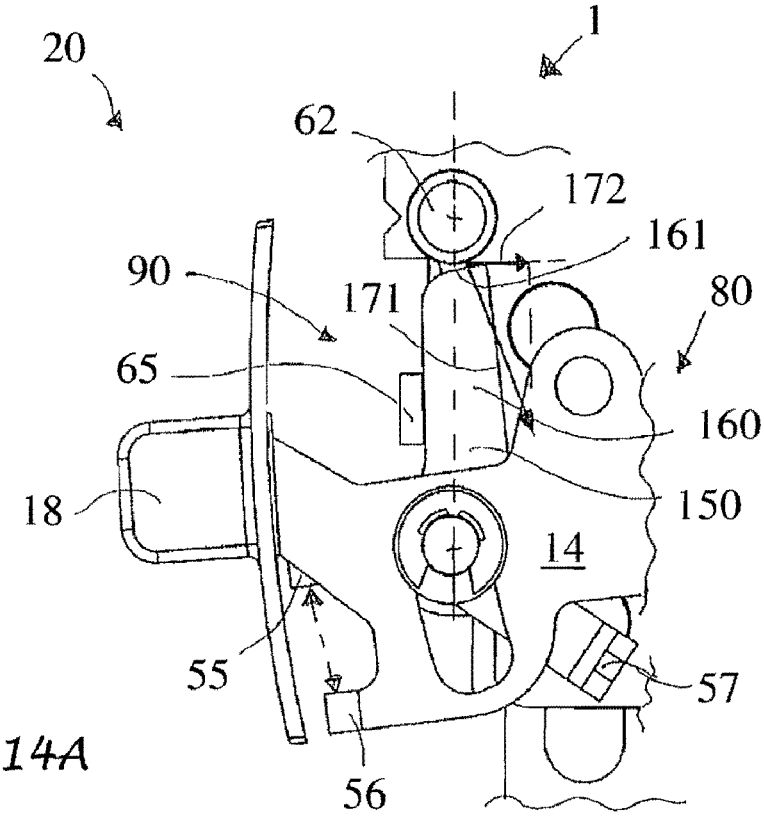
FIG. 14A is an enlarged view of a detail in FIG. 14.
Figure 15:
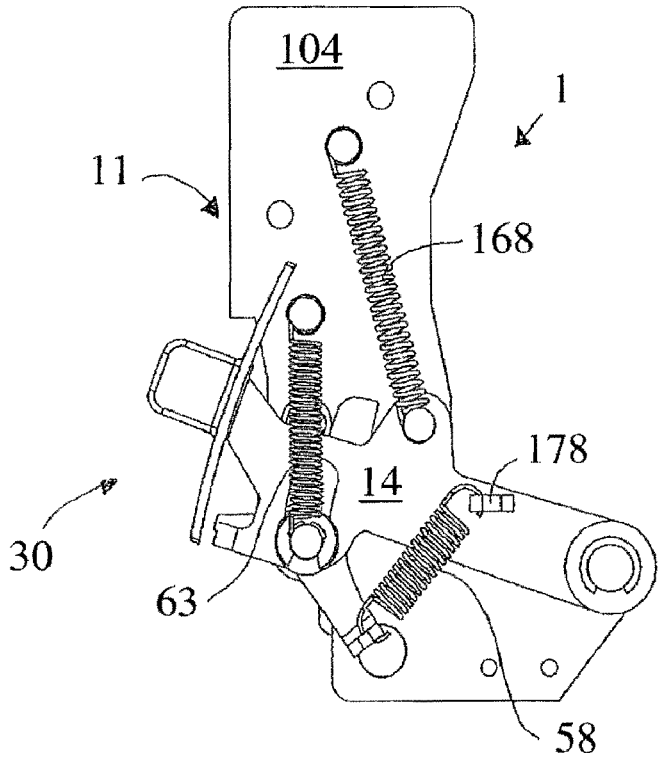
FIGS. 15 and 16 show the mechanical override device of FIG. 10 in an unlocking configuration and in a locking configuration, respectively.
Figure 16:
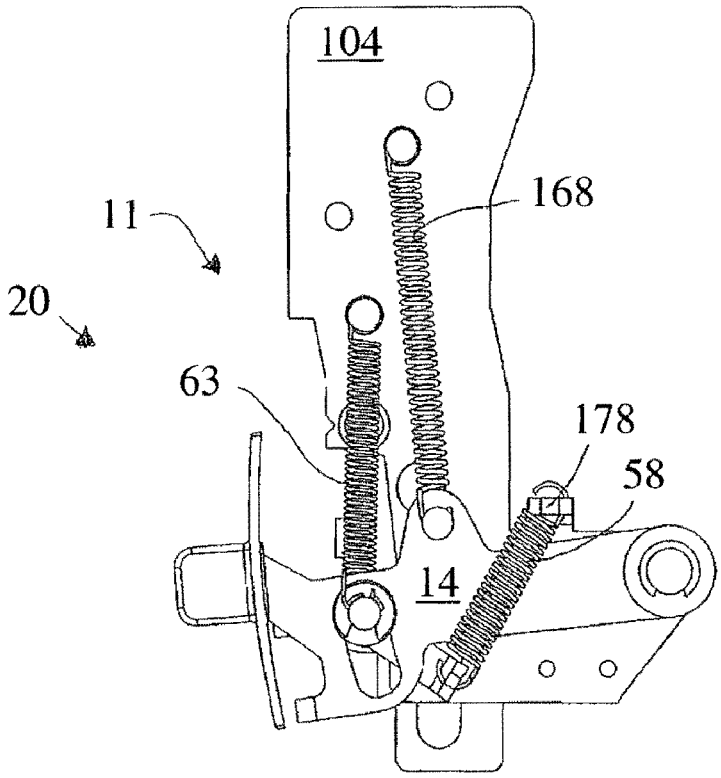
Figure 17:
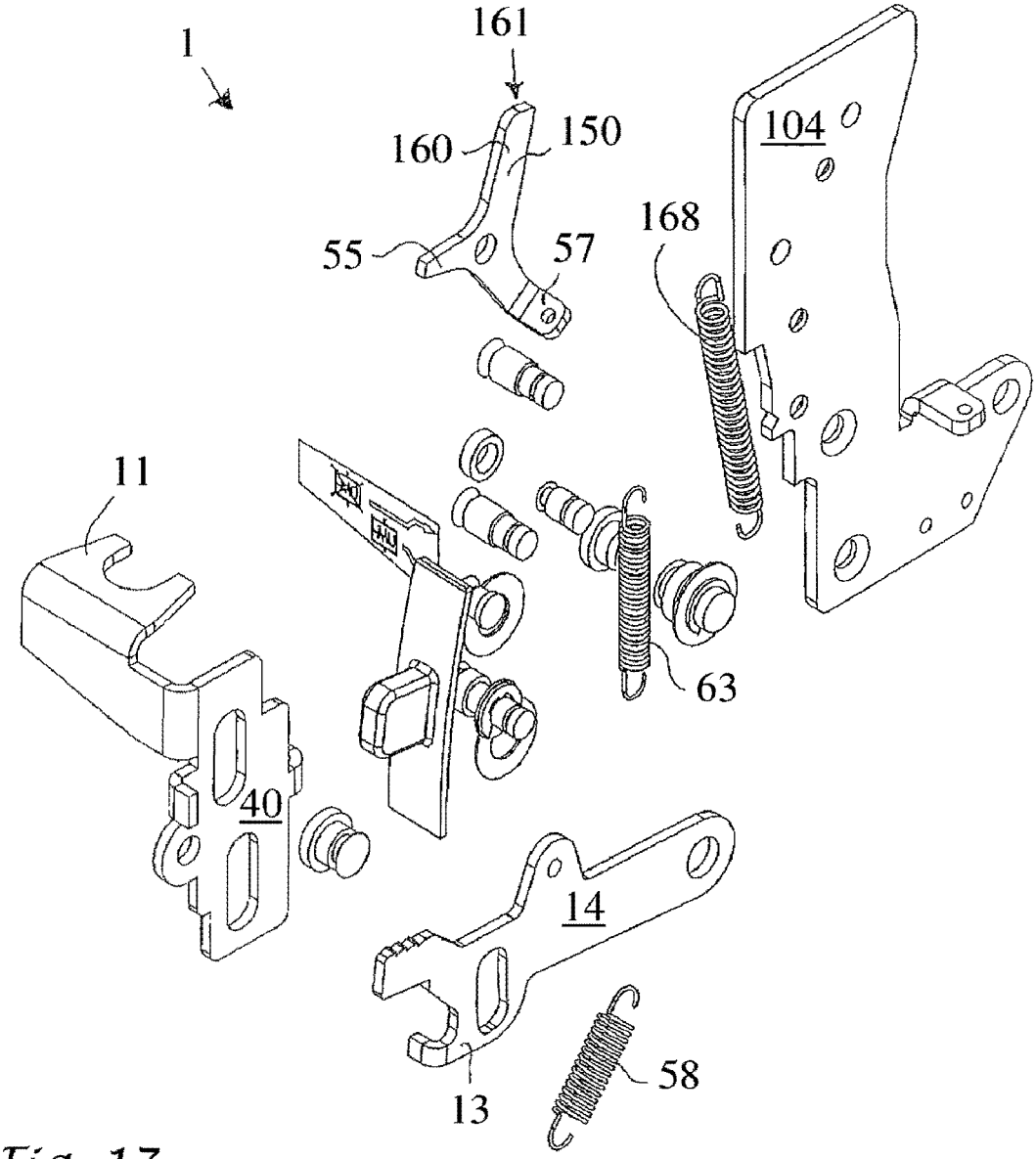
FIG. 17 is an exploded view of the mechanical override device of FIG. 10.

As illustrated for example in FIG. 14A, the device 1 comprises a temporary holding element 150 which is partly configured like the permanent holding element 50. The temporary holding element 150 comprises a biasing arm 57 and an unhooking arm 55 which are similar to those included in the permanent holding element 50. The biasing spring 58, differently from the permanent holding element 50, elastically connects the biasing arm 57 to a stationary connecting projection 178 of the supporting plate 104.

Furthermore, according to this exemplary embodiment, the mechanical override device 1 comprises a further return spring 168 which elastically connects the command lever 14 to a linking protrusion 169. The further return spring 168 exerts a traction force pulling the command lever 14 upwards.

The temporary holding element 150 comprises a holding arm 160 having a temporary holding end 161 which is shaped differently from the permanent holding end 61. In particular, the temporary holding end 161 has a profile which is properly shaped for cooperating with the lower surface of the holding protrusion 62 so as to temporary hold the holding element 150 in the locking configuration 20 only while the operator keeps the command lever 14 in the lower position. In other words, with reference to FIG. 14A, the profile of the temporary holding end 161 is slightly sloping towards the second region 90, i.e. the profile of the temporary holding end 161 is descending from the first region 80 towards the second region 90. In practice, the temporary holding end 161 is delimited by a surface which is shaped in such a way that an incident line drawn orthogonally on the temporary holding end 161 intersects the first region 80 and results convergent towards the biasing arm 57.

The temporary holding arm 160, in particular the temporary holding end 161 is configured so that, in the locking configuration 20, a further reaction force 171, which is exerted by the holding protrusion 62 on the temporary holding end 161, is directed to the first region 80 and has a further tangential component 172 pointing substantially away from the covering element 19. This means that the further reaction force 171 is such as to push and rotate the temporary holding element 150 away from the stop protrusion 65. However, as the command lever 14 is kept by the operator in the lower position, the biasing spring 58 keeps the temporary holding element 150 abutted against the stop protrusion 65. Also in this embodiment, there is an idling movement 67 for the command lever 14 which does not change the operative status of the device 1.

When the operator releases the command lever 14, the latter is pulled up by the further return spring 168. When the unhooking protrusion 56 contacts and pushes the unhooking arm 55, the temporary holding element 150 disengages from the holding protrusion 62 thus moving upwards in the unlocking configuration 30, shown in FIG. 15.

The mechanical override device thus conceived may undergo numerous modifications and come in several variants, all falling within the scope of the inventive concept as defined by the appended claims; the component materials and dimensions may be of any type, according to needs and the state of the art.

What is claimed is:

1. A mechanical override device suitable for an undervoltage coil of a switching unit, said undervoltage coil including a plunger moveable between a first excited position kept duing normal operation when the undervoltage coil is energized and a second non-excited position taken when the undervoltage coil is in an under voltage condition, wherein the mechanical override device comprises:

a first portion suitable for urging said plunger in said first excited position when said undervoltage coil is in said undervoltage condition;

a second portion suitable for receiving an external movement command; and movement control means for controlling one or more cinematic parameters of said first portion, wherein said first portion is movable, through an unlocking operating movement which is activated upon a releasing external command given by an operator on said second portion suitable for receiving an external movement command, from a locking position in which said first portion is suitable to keep said plunger urged in said first excited position, to an unlocking position in which said first portion does not act on said plunger, said movement control means being configured to render said unlocking operating movement of the first portion independent from the manner in which said releasing external command is given by the operator.

2. The mechanical override device according to claim 1, wherein said movement control means comprises permanent holding means cooperating with return means for permanently holding said first portion in said locking position once an external movement command directed to put said first portion in said locking position is completed and said second portion suitable for receiving an external movement command is released.

3. The mechanical override device according to claim 1, wherein said second portion comprises command lever means which is positionable in a first position or in a second position at which said locking position and said unlocking position of said first portion correspond respectively, said command lever means being movable from said first position to said second position along a plane path.

4. The mechanical override device according to claim 3, wherein said first portion is obtained on a slide element which is pivotally and slideably connected to said command lever means, said first portion comprising a coupling edge suitable for pulling a first end of said plunger, said first end being opposite to a second end of said plunger which interacts with a swinging mechanism configured for enabling/disabling driving operations on said switching unit.

5. The mechanical override device according to claim 4, wherein said slide element is connected to said command lever means through a first slot-pin connection, said slot-pin connection being connected to a return elastic element included in a return means, said return means for permanently holding said first portion in said locking position once an external movement command directed to put said first portion in said locking position is completed and said second portion is released.

6. The mechanical override device according to claim 4, further comprising a supporting element for movably supporting said command lever means and said slide element.

7. Mechanical override device according to claim 6, wherein said command lever means is rotatably connected to a pin element which is fixed to said supporting element and said slide element is slidable with respect to said supporting element through a second slot-pin connection.

8. Mechanical override device according to claim 3, wherein said permanent holding means or a temporary holding means is interposed between said command lever means and a slide element, and are pivotally and slideably connected to said command lever means and to said slide element through said second slot-pin connection.

9. Mechanical override device according to claim 8, wherein said permanent holding means or said temporary holding means comprises a permanent holding end or a temporary holding end respectively, which is configured for cooperating with a holding protrusion of a supporting element, said supporting element for movably supporting said command lever means and said slide element.

10. Mechanical override device according to claim 9, wherein said permanent holding end is so shaped as to be able to keep itself firmly engaged with said holding protrusion in said locking position without the need for any external action on said second portion.

11. Mechanical override device according to claim 10, wherein said permanent holding means comprises a permanent holding arm, on which said permanent holding end is provided, an unhooking arm for cooperating with an unhooking protrusion of said command lever means for unhooking said permanent holding means from said locking position, and a biasing arm connected to a biasing elastic element included in said return means, for biasing said permanent holding means towards said locking position.

* * * * *